US005205421A

United States Patent [19]

Bustos

[11] Patent Number: 5,205,421

[45] Date of Patent: Apr. 27, 1993

[54] GONDOLA DISPLAY RACK

[75] Inventor: Rafael T. Bustos, Alpharetta, Ga.

[73] Assignee: Leggett & Platt, Incorporated, Carthage, Mo.

[21] Appl. No.: 678,583

[22] Filed: Apr. 1, 1991

[51] Int. Cl.[5] ..... A47F 5/00

[52] U.S. Cl. ..... 211/59.2; 108/108; 211/187; 211/175

[58] Field of Search ..... 211/187, 193, 59.2, 211/175; 108/108, 109; 248/242

[56] References Cited

U.S. PATENT DOCUMENTS

| | | | |
|---|---|---|---|
| 3,182,945 | 5/1965 | Sedo | 248/242 |
| 3,832,957 | 9/1974 | Mendenhall | 108/108 X |
| 4,307,671 | 12/1981 | Albano | 108/108 X |
| 4,776,472 | 10/1988 | Rosen | 211/175 X |
| 5,022,541 | 6/1991 | White | 108/108 X |
| 5,096,074 | 3/1992 | Merl | 211/175 |

FOREIGN PATENT DOCUMENTS

| | | | |
|---|---|---|---|
| 674989 | 11/1964 | Italy | 248/242 |

*Primary Examiner*—Robert W. Gibson, Jr.
*Attorney, Agent, or Firm*—Wood, Herron & Evans

[57] ABSTRACT

A gondola display rack for merchandising product comprises a base having a top surface, at least one upright extending vertically from the rear of the base, and at least one shelf removably secured to the upright. Shelf supporting bracket means attach the shelf to the upright and include means for adjustment wherein the shelf may be positioned substantially horizontally or angled downwardly and forwardly, yet without any gap between the rear edge of the shelf and the upright as is typically experienced. The base includes adjustment means which allow the base top surface to be positioned substantially horizontally or angled downwardly and forwardly and which allows the depth of the base to be varied. The base further includes second adjustment means which allow the upright to be adjusted angularly with respect to the base.

15 Claims, 4 Drawing Sheets

GONDOLA DISPLAY RACK

BACKGROUND OF THE INVENTION

1. Field of the Invention

This invention relates to gondola display racks, and more particularly to improvements in a gondola display rack having a base, vertical uprights extending upwardly from the rear of the base, and shelves connected to the uprights and cantilevered over the base.

2. Description of the Prior Art

Gondola racks are widely used in marketing to pleasingly display goods or items for sale in a manner appealing to the average consumer. These types of gondola displays typically have a floor contacting base, a pair of uprights extending vertically from the rear of the base, and shelves connected to the uprights cantilevered over the base. The base also commonly has a shelf or surface thereatop. The shelves may be oriented substantially horizontally or may be tilted slightly, downwardly and forwardly, to produce a gravity type feed of product thereon. These types of display racks are commonly employed to display, for sale, items such as soft drinks, snacks and the like. A display utilized in this manner is commonly referred to in the industry as a "point of purchase" display.

One problem common to these types of gondola displays is the tendency of the uprights to be angled greater or less than 90° with respect to the base, or to otherwise deviate from true vertical. In other words, "slack" or "slop" in the connection between the base and the uprights tends to allow the uprights to tilt or deviate from true vertical. This problem may contribute to or amplify the tendency of a gondola to become unstable.

Another common problem which typical gondola displays share is the lack of a so-called "sweep" space beneath the shelf atop the base. This results due to the fact that most gondola bases have a display shelf thereatop which is typically downwardly and forwardly tilted so as to produce a gravity-type feed of the product thereon. A small gap results between the floor surface and the front edge of the shelf on the base, which allows errant paper, debris, and the like to be swept underneath this lowermost shelf. However, this space or gap between the floor surface and the base shelf is not so great as to allow one to, for example, sweep underneath the shelf with a broom of either the flat broom type or the push broom type. Accordingly, then, debris tends to accumulate underneath this lowermost shelf with no readily available means of cleaning up this debris, short of actually moving the gondola display from its original location to another location to allow for sweeping thereunder.

One other problem associated with these types of gondola displays is the fact that most shelves do not fit adjacent or abut the gondola uprights or the back panel of the display rack spanning between the uprights. This is usually due to the fact that the rear edge of the shelf does not itself engage the uprights, but relies upon some sort of cantilevered bracket to support the shelf from the upright. Most gondola displays employ sides having supporting brackets made integral thereto, such as by welding. If the bracket is configured to selectively orient the shelf either horizontally, or tilted downwardly and forwardly for gravity feed, invariably in one orientation a gap between the rear edge of the shelf and the forward surface of the gondola upright will result. This gap between the rear edge of the shelf and the gondola uprights or back of the gondola display can be as much as one inch or greater depending on the assembly. This gap or offset tends to cantilever the product displayed on the shelf further away from the gondola uprights, and in so doing tends to decrease the stability of the display. Furthermore, these shelves having supporting brackets made integral thereto present a geometry which is inefficient for packing and shipping purposes.

Another requirement of these types of gondola displays is the necessity to maintain the display in a stable relationship when all the shelves are fully loaded with product. In typical gondola displays the base may not be deep enough; at best, the shelves extend out from the gondola uprights the same distance as does the base, and at worst the shelves extend further out from the uprights than does the base. In either case, the depth of the base can be inadequate to prevent the display from being unstable under the moment load generated by product on the shelves.

Accordingly then, it has been one objective of the present invention to provide a gondola display rack which has a sufficient "sweep" space beneath the lowermost shelf which is atop the base to prevent debris from becoming irretrievably lodged underneath the lowermost shelf.

It has been another objective of the present invention to provide a gondola display which remedies the "slack" or slop" between the gondola uprights and the gondola base, so as to insure a stable, 90° relationship therebetween.

It has been yet another objective of the present invention to provide a gondola display rack which eliminates the space or gap between the rear edge of the shelves and the gondola uprights or back of the display, which commonly results from one-piece shelf-bracket units selectively movable between horizontal and gravity feed positions.

It has been still another objective of the present invention to provide a gondola display rack which has a base of sufficient depth to insure stability of the rack when it is fully loaded with product.

SUMMARY OF THE INVENTION

The present invention is a gondola display rack for merchandising products on the rack. The rack comprises a base which includes a top surface having front and rear edges, at least one upright extending vertically from the rear edge of the base and having a column of vertically spaced slots therein, at least one shelf including a top surface and an underside and having front and rear edges, and shelf supporting bracket means separable from the shelf and being selectively engageable with the slots in the upright and being removeably engageable with the underside of the shelf to support the shelf from the upright in a position cantilevered over the base.

In one embodiment, the shelf supporting bracket means includes adjustment means wherein the shelf top surface may be positioned substantially horizontally or angled downwardly and forwardly. In this embodiment, the shelf includes means for engaging the slots in the upright. The shelf is positionable in either a horizontal position, or a downwardly and forwardly tilted gravity feed position, and in both instances, the rear edge of the shelf remains adjacent the upright eliminating any gap therebetween. The adjustment means of the bracket means comprises at least two tangs extending rearwardly from the bracket means, with each tang including a pair of notches in a lower edge thereof. The rearwardmost notches engage the upright to position the shelf thereatop in a substantially horizontal position, while the forwardmost notches are utilized to engage the upright and cant the shelf downwardly and forwardly for gravity feed.

In another embodiment, each shelf supporting bracket includes an offset. The offset allows for shelves to be used with gondola uprights having slots therein and which are spaced apart in various widths. In this embodiment, the shelf does not engage the uprights.

The base of the display incorporates adjustment means which allow the base top surface to be positioned substantially horizontally or angled downwardly and forwardly, while also allowing the depth of the base to be varied. This is accomplished via a two piece base construction which comprises a fixed base member and a telescoping base member. The telescoping base member is operable to telescope into and out of the fixed base member. The top surface of the base is operable to be pivoted upwardly as the telescoping base member is telescoped out of the fixed base member, and to be pivoted downwardly as the telescoping base member is telescoped into the fixed base member. The variable depth base further allows for variable depth base shelves to be employed thereatop.

The gondola display rack of the present invention further includes adjustment means which allow the upright to be adjusted angularly with respect to the base. The adjustment means comprises screw means operable between the base and the upright. The base is pinned to the upright, and when the screw means is rotated in a first direction the angle between the upright and the base is increased; when the screw means is rotated in a second direction the angle between upright and the base is decreased. This feature allows the gondola to be adjusted to a true vertical attitude.

One advantage of the present invention is that a gondola display has been provided which allows for sweeping beneath the lowermost shelf atop the base.

Another advantage of the present invention is that the slop or slack normally associated with the gondola upright connection to the base is eliminated, thereby increasing the stability of the display.

Yet another advantage of the present invention is that a gondola display has been provided which has a variable depth base which insures a stable gondola display when the display is fully loaded, and which may be varied based on the amount of product on the display.

Still another advantage of the present invention is that the gap normally associated with the connection between the rear edge of a gondola shelf and the gondola uprights or back has been eliminated, thereby tending to reduce the moment load created by the product atop the shelf about the base.

These and other objects and advantages of the present invention will become more readily apparent during the following detailed description taken in conjunction with the drawings herein, in which:

DESCRIPTION OF THE PREFERRED EMBODIMENTS

Figure 1:
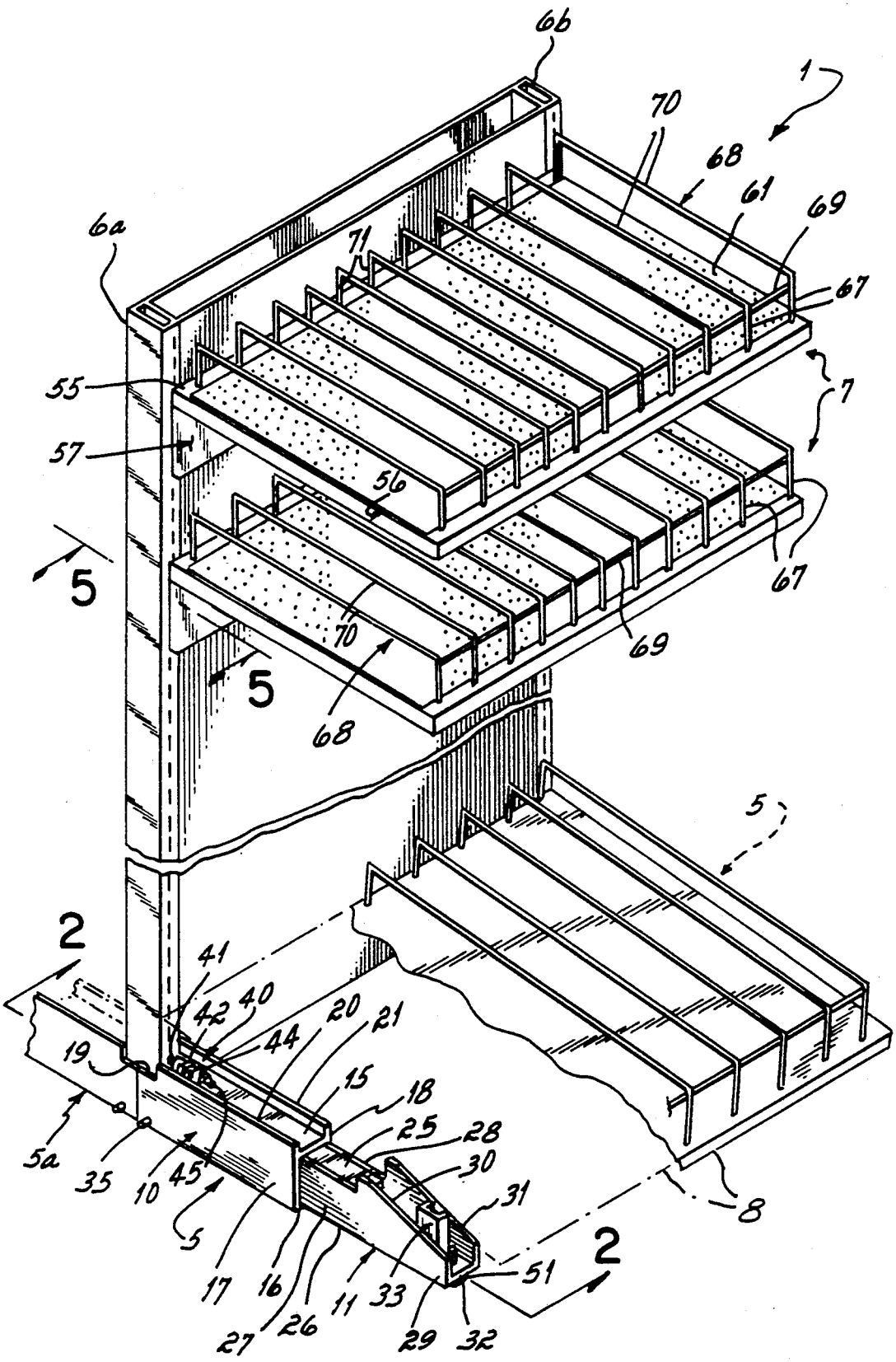
FIG. 1 is a perspective view of the gondola display of the present invention.

With reference to FIG. 1, there is illustrated a gondola display 1 of the present invention. The gondola display 1 comprises, generally, a base 5, a pair of vertical gondola uprights 6*a* and 6*b* extending upwardly from the rear of the base 5, a plurality of shelf assemblies 7 cantilevered from the uprights 6*a* and 6*b* out over the base 5, and a base shelf 8 atop the base 5.

Figure 2:
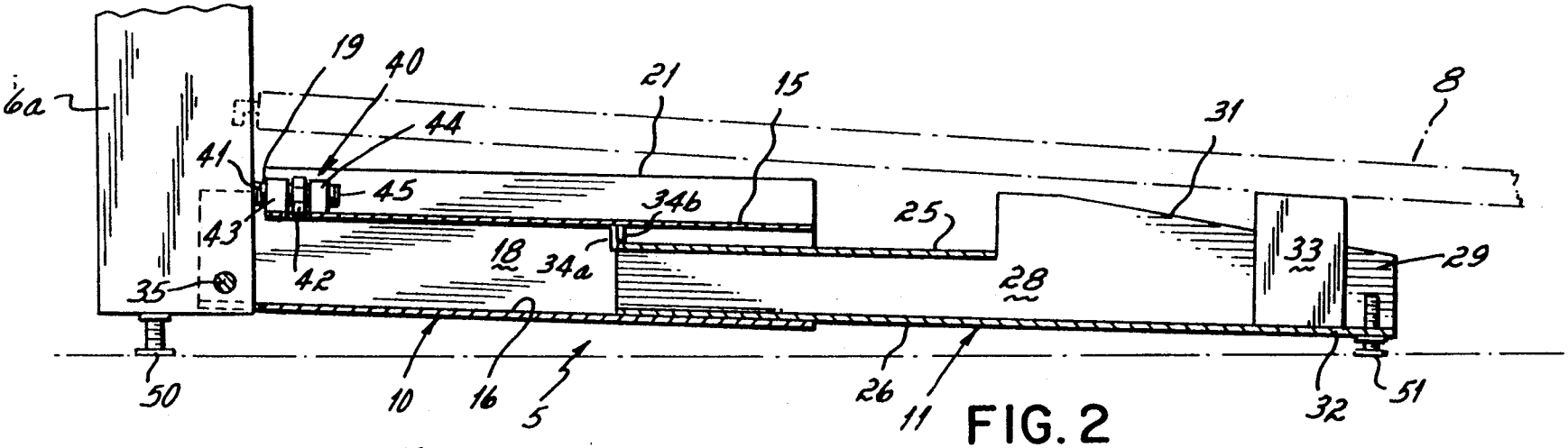
FIG. 2 is a view taken along lines 2—2 of FIG. 1 and illustrating the adjustable gondola base in the extended configuration.
Figure 3:
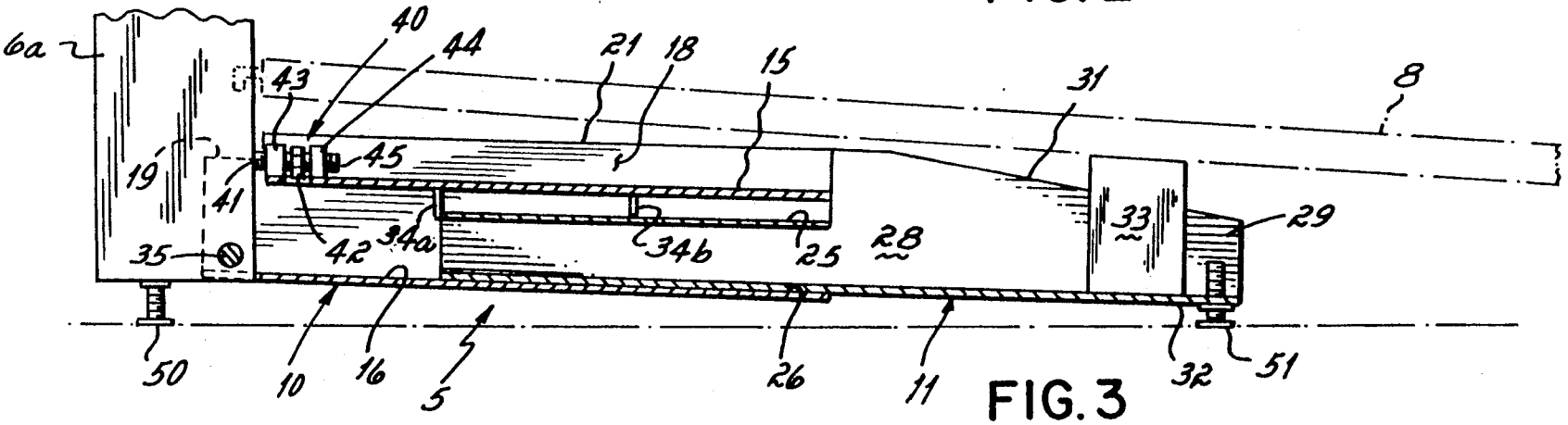
FIG. 3 is a view similar to FIG. 2 but illustrating the gondola display base with the base retracted.

Describing the base 5 in more detail, and referring now to FIGS. 1-3, this novel base 5 is essentially of a two-piece construction, comprising a fixed foot or shoe 10, and a movable foot or shoe 11 which telescopes into and out of the fixed foot or shoe 10. While only one base 5 is illustrated in the drawings, it is to be understood that a completed gondola display assembly 1 includes a base 5 on each end of the display; however only one is illustrated in these drawings for clarity.

The fixed foot 10 is a rectangular box section having a top 15, a bottom 16 and sides 17 and 18. At its rearwardmost end, the top 15 is relieved at 19 such that when the gondola upright 6*a* or 6*b* is fitted adjacent the rear edge of the top 15, the rearwardmost edges of the sides 17 and 18 span across approximately half the width of the upright 6*a* or 6*b*. In this manner, should one wish to employ shelves on both sides of the uprights 6*a* and 6*b*, a similar base 5*a* can be attached to the other side of the uprights 6*a* and 6*b*. The fixed foot 10 further includes upwardly extending flanges 20 and 21 which essentially are extensions of the sides 17 and 18, respectively.

The movable foot 11 is likewise in the form of a rectangular box section having a top 25, a bottom 26, and sides 27 and 28. At the forward end of the movable foot 11 there is essentially an upturned channel section 29 having downwardly, forwardly sloping flanges or sides 30 and 31 and a web or bottom 32. A block 33 is connected to the upper side of the bottom 32 of the movable foot 11 and serves as a rest atop which the base shelf 8 resides. The base 5 further includes threaded feet 50 and 51 to aid in leveling the display 1 or in otherwise compensating for an uneven floor surface.

To adjust the base 5, the movable foot 11 is simply slid into or out of the fixed foot 10. It will be appreciated that pulling the foot 11 out of the foot 10 provides the display 1 with a deeper, more stable base, while simultaneously raising the base shelf 8 to a substantially horizontal position, thus facilitating sweeping thereunder. When the foot 11 is in the fully extended position (FIG. 2), an upturned tang 34*a* extending upwardly from the rear edge of the top 25 of the foot 11 contacts a downwardly extending tang 34*b* extending downwardly from the lower surface of the top 15 of the foot 10 approximately two thirds the distance from its rear edge to its front edge. When fully retracted (FIG. 3), the rear edges of the flanges 30 and 31 contact the forward edge of the top 15 of the foot 10.

This adjustable base 5 further allows for various depths of base shelves 8. For example, when the base 5 is extended (FIG. 2), a deeper base shelf 8 may be employed thereatop, which would allow for more product to be displayed thereon.

The base 5 is connected to the gondola upright 6*a* by pin 35 which passes through the rear ends of the sides 17 and 18 of the fixed foot 10 and the upright 6*a*. In order to create moment bearing capability at this pinned joint, and to provide a novel means of adjusting the angular relationship between the base 5 and upright 6*a*, a novel anti-slack or anti-slop mechanism designated generally by the numeral 40 is located on the top 15 of the fixed foot 10 in a rearwardmost location. This mechanism 40 serves both to provide moment load bearing capability to the upright 6*a*/foot 10 connection, and to finely adjust the angle of the upright 6*a* with respect to the base 5 so as to position the upright 6*a* in a true vertical orientation. Of course, similar adjustment capability is provided for base 5 and its attachment to upright 6*b*.

This mechanism 40 comprises a threaded bolt or stud 41 which has threaded thereon and located medially along the length thereof a nut 42. This nut 42 is captured for non-rotation between sleeves 43 and 44 which, themselves, are fixedly attached to the top 15 of the fixed foot 10. The bolt 41 includes in a forward end thereof at 45 means for inserting an Allen head wrench for adjusting the bolt 41.

To adjust this mechanism 40, the bolt 41 is rotated clockwise to increase the angle between the upright 6*a* and fixed foot 10. The rear end of the bolt 41 is forced against the front surface of the upright 6*a*, causing the upright 6*a* to pivot about the pin 35. It will be appreciated that product located atop the shelf assemblies 7 will provide a moment load which maintains the upright 6*a* in contact with the rear end of the bolt 41. Therefore, when bolt 41 is rotated counterclockwise, the moment load atop the shelf assemblies causes the angle between the upright 6*a* and foot 10 to decrease. In this manner, the upright may be adjusted to true vertical.

Referring now to FIG. 1, and FIGS. 4–6, it will be noted that each shelf assembly 7 comprises, generally, a shelf 55, a shelf arm 56 and a shelf support bracket 57.

The shelf 55 includes a shelf plate 60 which is overlaid with a low coefficient of friction slip surface 61, which facilitates sliding of product atop the surface 61 in gravity feed fashion. Fixedly connected to the underneath side of the shelf plate 60 are a plurality of transverse stiffeners 62, 63, 64, and 65 which provide additional bending stiffness to the shelf plate 60. The forwardmost stiffener 65 includes a plurality of holes 66 for accepting wire legs 67 of a wire divider rack 68 (FIG. 1). The wire divider rack 68 includes a bumper wire 69 located near the forwardmost edge of each shelf assembly 7, and a plurality of row dividing wires 70 spanning between the forward and rearward edges of the shelf assembly 7. Divider rack legs 71 tie the rack 68 into the rearwardmost edge of the shelf assembly 7.

Figure 4:
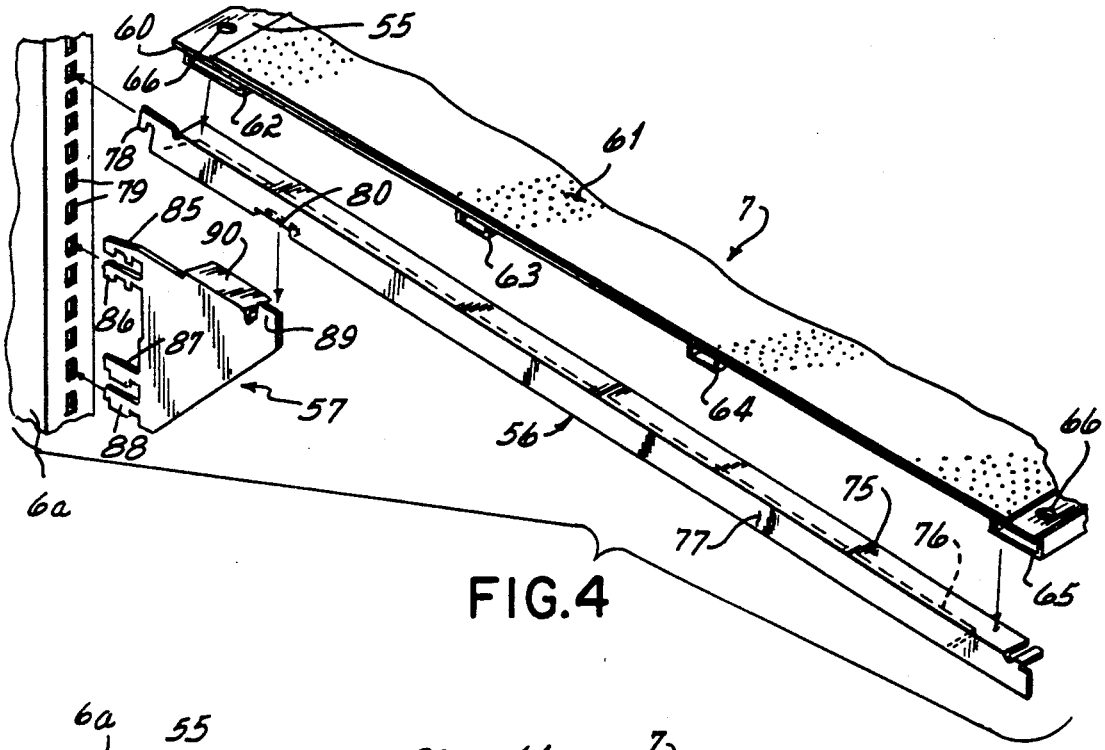
FIG. 4 is a partial perspective view in exploded form illustrating the connection between the gondola upright, the shelf supporting bracket, and the shelf of the present invention.

Referring to FIG. 4, and describing now the shelf arm 56, this arm 56 is a channel section having upper and lower flanges 75 and 76 and a side or web 77. The shelf 55 is secured to the upper flange 77 of the arm 56 by conventional fasteners. An upturned tang 78 is located on the rearwardmost end of the arm 56 and is engageable with one of the slots 79 in the gondola upright 6*a*. A slot 80 spaced a short distance from the rear end of the arm 56 engages the bracket 57 during assembly, as will be more fully explained hereafter.

Describing now the shelf bracket 57 in more detail, this bracket 57 is generally triangular shaped, and has two upper tangs 85 and 86, and two lower tangs 87 and 88, all four of which are rearwardly extending and are located on a rearwardmost edge of the bracket 57. Located on the forward corner of the bracket 57 is a fifth upwardly extending tang 89. A portion of the sheet metal stamping from which the shelf bracket 57 is fabricated is bent at a right angle to the bracket body and forms a rectangular surface 90.

Figure 5:
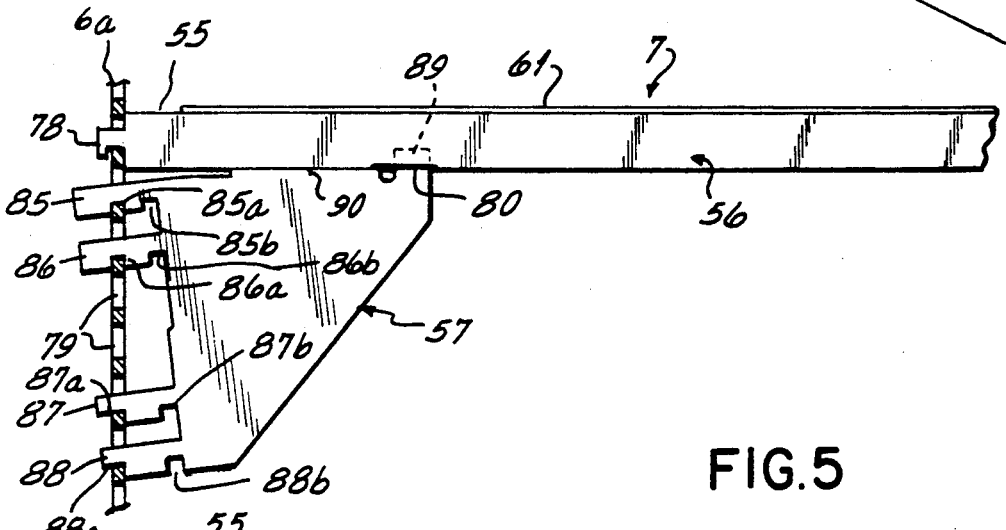
FIG. 5 is a view along lines 5—5 of FIG. 1 illustrating the assembled shelf, shelf bracket, and gondola upright, except illustrating the shelf oriented horizontally.
Figure 6:
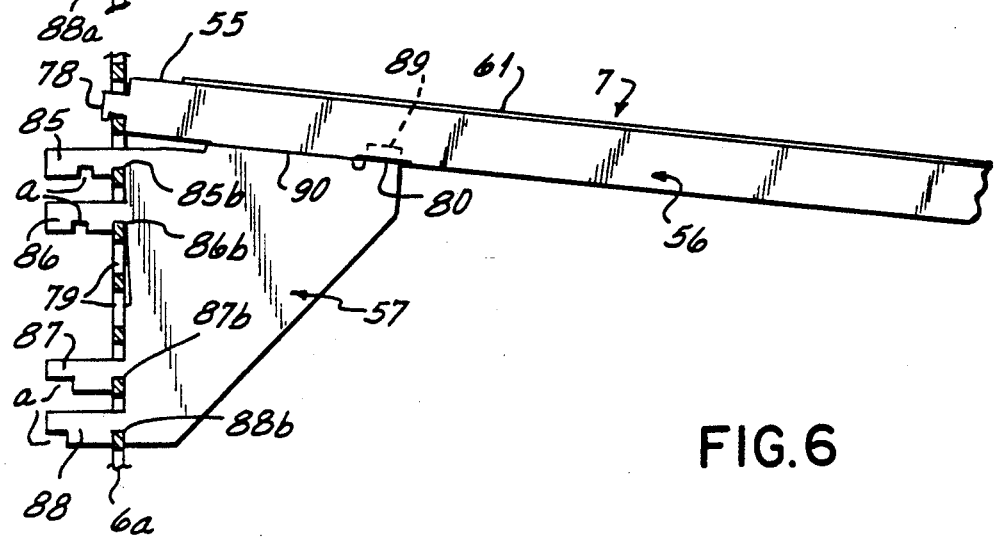
FIG. 6 is a view similar to FIG. 5 illustrating the gondola shelf of FIG. 1 configured for gravity feed.

Referring now to FIGS. 5–6, and describing the novel bracket 57 in more detail, the upper and lower bracket tangs 85 and 86 include upwardly extending notches 85*a*, 85*b* and 86*a*, 86*b*, respectively, on respective lower edges thereof. The lower tangs 87 and 88 include upwardly extending notches or relieved areas 87*a* and 88*a*, respectively, and upwardly extending notches 87*b* and 88*b*, respectively, on respective lower edges thereof.

To orient a shelf 55 of shelf assembly 7 horizontally on the gondola display 1, it will be seen from FIG. 5 that the notches 85*a* and 86*a*, and the relieved areas 87*a* and 88*a*, are utilized. The tangs 85 and 86 of the bracket 57 are inserted through adjacent holes 79 in the upright 6*a* until the grooves 85*a* and 86*a* may be lowered downwardly onto the lower edges of these holes 79. Simultaneously, the lower tabs 87 and 88 are inserted through adjacent holes 79 until the relieved areas 87*a* and 88*a* abut the front surface of the upright 6*a*. The tang 78 of the shelf arm 56 having been inserted through a hole 79 above the shelf bracket 57, this arm 56 is then simply lowered onto the bracket 57. The front tang 89 of the bracket 57 fits within the slot 80 in the arm 56, with that portion of the arm lower flange 76 rearward of the slot 80 resting atop the top surface 90 of the bracket 57. With the bracket 57 in this orientation, the shelf arm 56 and hence the shelf 55 secured to the arm 56 is positioned in a substantially horizontal orientation.

Referring now to FIG. 6, the shelf arm 56 and shelf bracket 57 are illustrated configured for gravity feed of product atop the shelf 55. In this configuration, the tange 85–88 of the shelf bracket 57 are inserted completely through the slots 79 in the upright 6*a* until the notches 85*b*, 86*b*, 87*b* and 88*b* may be lowered onto the lower edges of these slots 79. As can be seen, the shelf arm 56 pivots about the slot 79 through which the tange 78 is inserted, and is thereby tilted forwardly and downwardly. The tang 89 of the bracket 57 remains engaged within the slot 80 of the arm 56; similarly the lower flange 76 of the arm 56 rests atop the surface 90 of the bracket 57.

It will be noted that in both the shelf orientations illustrated in FIGS. 5 and 6 the rear edge of the shelf abuts the font or forward surface of the upright 6*a*, thereby eliminating any gap or space therebetween. Since the bracket 57 and shelf 55 are separate, the bracket 57 is free to move relative to the shelf 55, thereby allowing the shelf 55 to remain adjacent the forward surface of the upright 6*a*. This serves to decrease the moment load created by product atop the shelf, for a given shelf depth. And, a more efficient packing and shipping geometry is presented since these items are separable.

Figure 7:
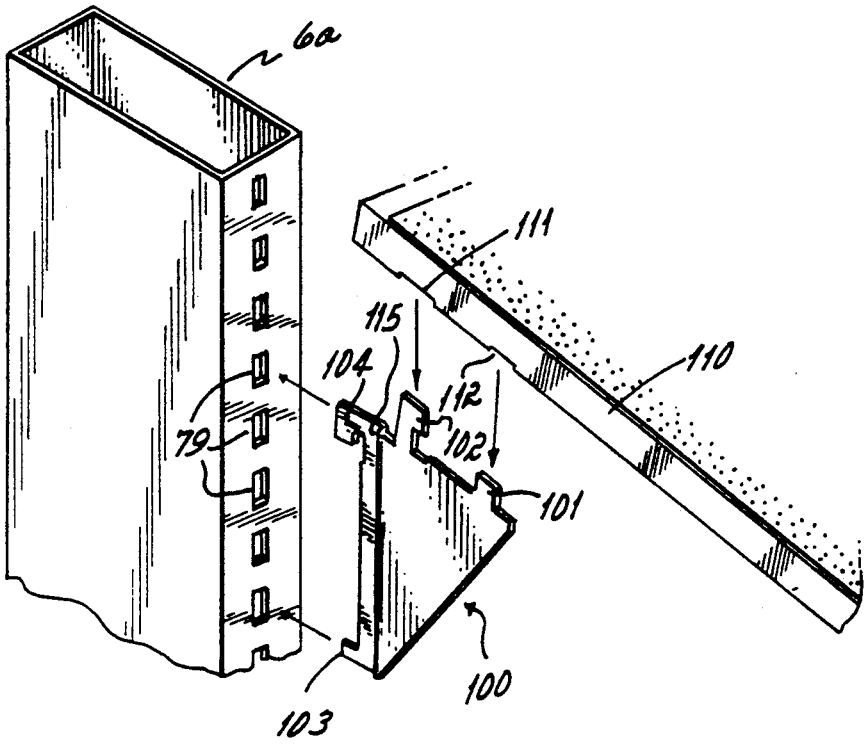
FIG. 7 is a partial perspective view of an alternative embodiment of the shelf and shelf supporting bracket, in exploded form.
Figure 8:
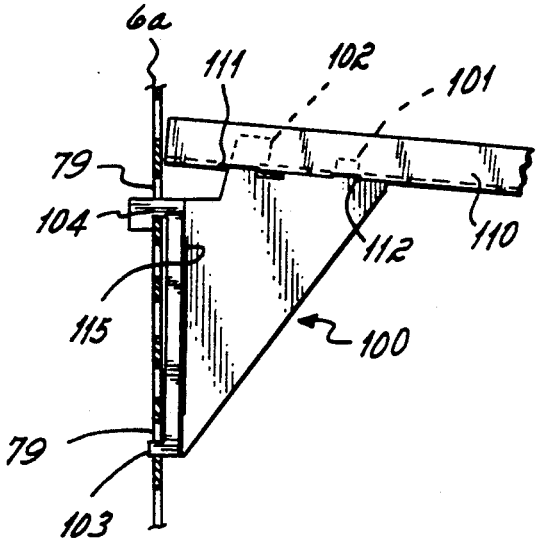
FIG. 8 is a view illustrating the alternative embodiment of the shelf supporting bracket and shelf of FIG. 1 in assembled form.

Referring now ti FIGS. 7 and 8, there is illustrated an alternative embodiment of the shelf supporting bracket means of the present invention. A bracket 100, generally triangularly shaped, includes an upwardly extending front tab 101 and an upwardly and forwardly extending hook-shaped rear tab 102 on an upper edge thereof. The bracket 100 further includes a rearwardly extending lower tab 103 and a rearwardly and downwardly extending hook-shaped upper tab 104 on a rear edge thereof. The shelf arm 110 includes slots 111 and 112 which accept the tabs 101 and 102 of the bracket 100. Similar to that previously described, the tabs 103 and 104 are inserted through the slots 79 in the upright 6a. The bracket 100 is then lowered slightly to allow the lower edge of the slot 79 to reside within the hook-shaped upper tab 104. This securely locks the bracket and shelf arm to the upright 6a. As can be seen from FIG. 8, the shelf arm 110 secured to the bracket 100 is canted forwardly and downwardly to allow for gravity feed atop the shelf assembly.

The bracket 100 includes an offset 115. This offset bracket, which is described in U.S. Pat. No. 4,872,567, allows shelves to be used with gondola uprights having slots and spaced apart in various widths. A similar bracket (not shown) on the other side of the shelf includes a similar offset, but reversed from the offset 115 in the bracket 100. By interchanging the differently offset brackets, the differing bracket offsets allow accomodation of two upright spacings for each transverse position of the bracket.

Those skilled in the art will recognize changes and modifications which can be made to the present invention without departing from its spirit or scope. Accordingly, I intend to be limited only by the following claims.

What is claimed is:

1. A gondola display rack for merchandising product supported on said rack, said rack comprising:

a floor contacting base having a rear edge, a shelf atop said base, at least one upright extending vertically from said rear edge of said base, said upright having a column of vertically spaced slots therein.

at least one other shelf having a rear edge, said at least one other shelf including engaging means for engaging said slots of said upright, and shelf supporting bracket means separable from said at least one other shelf and being selectively engageable with said slots of said upright and being removably engageable with said underside of said at least one other shelf to support said at least one other shelf from said upright in a position cantilevered over said base.

2. The gondola display rack of claim 1 wherein said shelf supporting bracket means includes adjustment means whereby said at least one other shelf may be positioned substantially horizontally or angled downwardly and forwardly.

3. The gondola display rack of claim 2 wherein said rear edge of each said at least one other shelf abuts said upright so as to substantially eliminate any gap therebetween when said at least one other shelf is positioned either horizontally or tilted downwardly and forwardly.

4. The gondola display rack of claim 3 wherein said bracket adjustment means comprises at least two tangs extending rearwardly from said bracket means and wherein each said tang includes a pair of notches in a lower edge thereof.

5. The gondola display rack of claim 1 wherein said bracket means comprises a pair of brackets, one at either end of said shelf, each of which includes an offset therein so that columns of vertically spaced slots of different spacing may be accommodated.

6. The gondola display rack of claim 1 wherein said base includes adjustment means whereby said shelf atop said base may be positioned substantially horizontally or angled downwardly and forwardly, and wherein a depth dimension of said base may be varied.

7. The gondola display rack of claim 1 wherein said base includes adjustment means whereby said upright may be adjusted angularly with respect to said base.

8. A gondola display rack for merchandising product supported on said rack, said rack comprising:

a floor contacting base having a rear edge, said base having a depth dimension associated therewith, a shelf atop said base, at least one upright extending vertically from said rear edge of said base, said upright having a column of vertically spaced slots therein, at least one other shelf having a rear edge, shelf supporting bracket means for supporting said at least one other shelf from said upright in a position cantilevered over said base, and adjustment means on said base whereby said shelf atop said base may be positioned substantially horizontally or angled downwardly and forwardly, and wherein said depth dimension of said base may be varied.

9. The gondola display rack of claim 8 wherein said base adjustment means comprises a fixed base member and a telescoping base member, said telescoping base member being operable to telescope into and out of said fixed base member, said shelf atop said base being operable to be pivoted upwardly as said telescoping base member is telescoped out of said fixed base member, and being operable to be pivoted downwardly as said telescoping base member is telescoped into said fixed base member.

10. The gondola display rack of claim 8, said shelf supporting bracket means being separable from said at least one other shelf and being selectively engageable with said slots of said upright and being removably engageable with an underside of said at least one other shelf.

11. The gondola display rack of claim 8, wherein said base includes adjustment means whereby said upright may be adjusted angularly with respect to said base.

12. A gondola display rack for merchandising product supported on said rack, said rack comprising:

a floor contacting base having a rear edge, a shelf atop said base, at least one upright extending vertically from said rear edge of said base, said upright having a column of vertically spaced slots therein, at least one other shelf having a rear edge, shelf supporting bracket means for supporting said at least one other shelf from said upright in a position cantilevered over said base, and adjustment means on said base whereby said upright may be adjusted angularly with respect to said base.

13. The gondola display rack of claim 12 wherein said upright is pinned to said base and wherein said adjustment means comprises screw means operable between said upright and base, wherein when said screw means is rotated in a first direction an angle between said upright and said base is increased, and wherein when said screw means is rotated in a second direction said angle is decreased.

14. The gondola display rack of claim 12, said shelf supporting bracket means being separable from said at least one other shelf and being selectively engageable with said slots of said upright and being removably engageable with an underside of said at least one other shelf.

15. The gondola display rack of claim 12 wherein said base includes adjustment means whereby said shelf atop said base may be positioned substantially horizontally or angled downwardly and forwardly, and wherein a depth dimension of said base may be varied.

* * * * *

UNITED STATES PATENT AND TRADEMARK OFFICE

CERTIFICATE OF CORRECTION

PATENT NO. : 5,205,421

DATED : April 27, 1993

INVENTOR(S) : Rafael T. Bustos

It is certified that error appears in the above-identified patent and that said Letters Patent is hereby corrected as shown below:

Column 6, line 50, change "tange" to -- tangs --.

Column 6, line 54, change "tange" to -- tang --.

Column 6, line 62, change "font" to -- front --.

Column 7, line 4, change "ti" to -- to --.

Column 7, line 47, change "slots therein." to -- slots therein, --.

Signed and Sealed this

Twenty-third Day of August, 1994

Bruce Lehman

*Attest:*

BRUCE LEHMAN

*Attesting Officer*

*Commissioner of Patents and Trademarks*